US006815628B2

(12) United States Patent
Okita et al.

(10) Patent No.: US 6,815,628 B2
(45) Date of Patent: Nov. 9, 2004

(54) METAL DOME TACT SWITCH

(75) Inventors: Masao Okita, Furukawa (JP); Fang-Jwu Liao, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/315,354

(22) Filed: Dec. 9, 2002

(65) Prior Publication Data

US 2004/0074754 A1 Apr. 22, 2004

(51) Int. Cl.[7] ..... H01H 13/52
(52) U.S. Cl. ..... 200/406; 200/534
(58) Field of Search ..... 200/406, 516, 200/534, 245

(56) References Cited

U.S. PATENT DOCUMENTS 3,996,547 A * 12/1976 Kinjo ..... 200/406
4,463,234 A * 7/1984 Bennewitz ..... 200/516
4,703,139 A * 10/1987 Dunlap ..... 200/516
5,660,272 A 8/1997 Janniere
5,999,084 A * 12/1999 Armstrong ..... 200/516
6,018,132 A 1/2000 Chen
6,180,903 B1 1/2001 Chen
6,323,449 B1 11/2001 Janniere
6,392,177 B1 5/2002 Zhang et al.

* cited by examiner

*Primary Examiner*—Renee Luebke
(74) *Attorney, Agent, or Firm*—Wei Te Chung

(57) ABSTRACT

A tact switch (100) includes a top cover (1), an actuator (2), a metal dome (3), a rubber disc (4), a conductive disc (5) and a housing (6). The housing has four contacts (7) retained therein. The rubber disc is attached to an underside of the metal dome, and the conductive disc is attached to the rubber disc. The metal dome fits into a bottom of the housing with the conductive disc spaced a short distance above the contacts. The actuator is slidably mounted above the metal dome. The top cover is mounted on the housing and includes a plate (11) with a curved lever (12) extending therefrom. The curved lever confronts a ramp (211) of the actuator. In operation, when the actuator is pressed into the housing, the lever of the top cover is forced downwardly by the ramp of the actuator to depress the metal dome, which pushes the conductive disc into electrical connection with the contacts.

2 Claims, 4 Drawing Sheets

METAL DOME TACT SWITCH

CROSS-REFERENCE TO RELATED APPLICATION

The present application is related to a commonly assigned U.S. patent application, entitled "ELECTRICAL SWITCH", invented by Chien-Jung Huang and Fang-Jun Liao.

BACKGROUND OF THE INVENTION

1. Field of the Invention

The present invention relates to a tact switch in which a plurality of separate contacts may be electrically connected together with a small transmission path via operation on the tact switch.

2. Description of Prior Art

Moreover in the above prior art, a distance between the metal dome and the contacts is too large, in operation, the metal dome will be distorted largely which makes the response time longer of the tact switch.

Hence, an improved tact switch is desired to overcome the disadvantages of the prior art.

BRIEF SUMMARY OF THE INVENTION

A main object of the present invention is to provide a tact switch having a simplified and improved subassembly and a shortened response time.

A tact switch in accordance with the present invention comprises a top cover, an actuator, a metal dome, a rubber disc, a conductive disc and a housing. The insulative housing has a plurality of contacts retained therein. The rubber disc is attached to an underside of the metal dome, and the conductive disc is attached to the rubber disc. The metal dome fits into a bottom of the housing with the conductive disc spaced a short distance above the contacts. The actuator is slidably mounted above the metal dome. The top cover is then mounted on the housing. The top cover includes a plate with a curved lever extending therefrom, the curved lever defining an upper contacting portion and a lower depressing portion. The curved lever of the top cover confronts a ramp of the actuator. In operation, when the actuator is pressed inwardly, the lever of the top cover is forced downwardly by the ramp of the actuator to depress the metal dome, which pushes the conductive disc into electrical contact with all of the contacts, simultaneously electrically connecting the four contacts.

Other objects, advantages and novel features of the invention will become more apparent from the following detailed description of the present embodiment when taken in conjunction with the accompanying drawings.

DETAILED DESCRIPTION OF THE INVENTION

Figure 1:
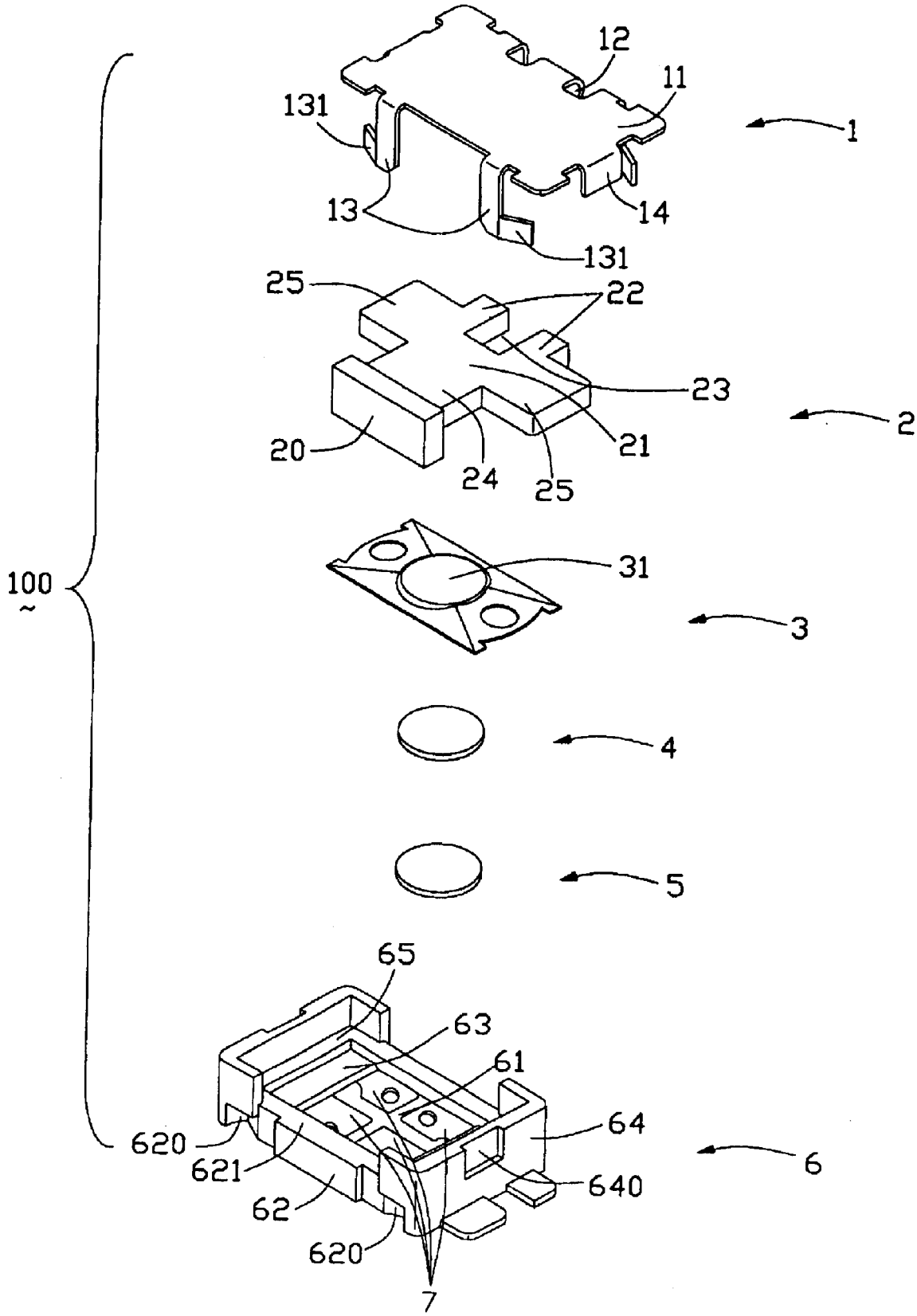
FIG. 1 is an exploded view of a tact switch in accordance with the present invention.
Figure 2:
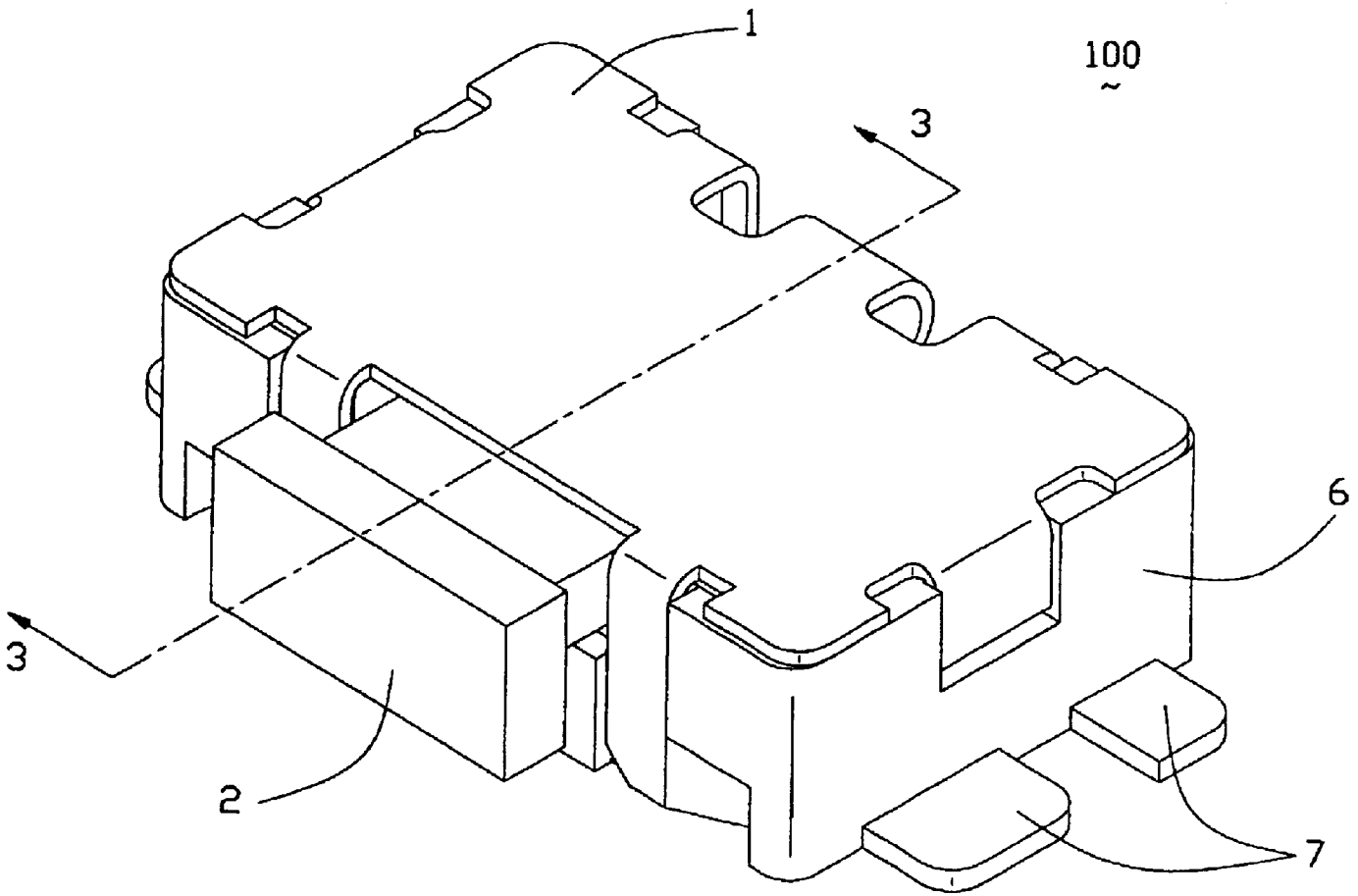
FIG. 2 is an assembled view of the tact switch of FIG. 1.

Referring to FIGS. 1 and 2, a tact switch 100 in accordance with an embodiment of the present invention comprises a top cover 1, an actuator 2, a metal dome 3, a compressible rubber disc 4, a conductive disc 5, a housing 6 and four contacts 7 insert molded with the housing 6.

Figure 3:
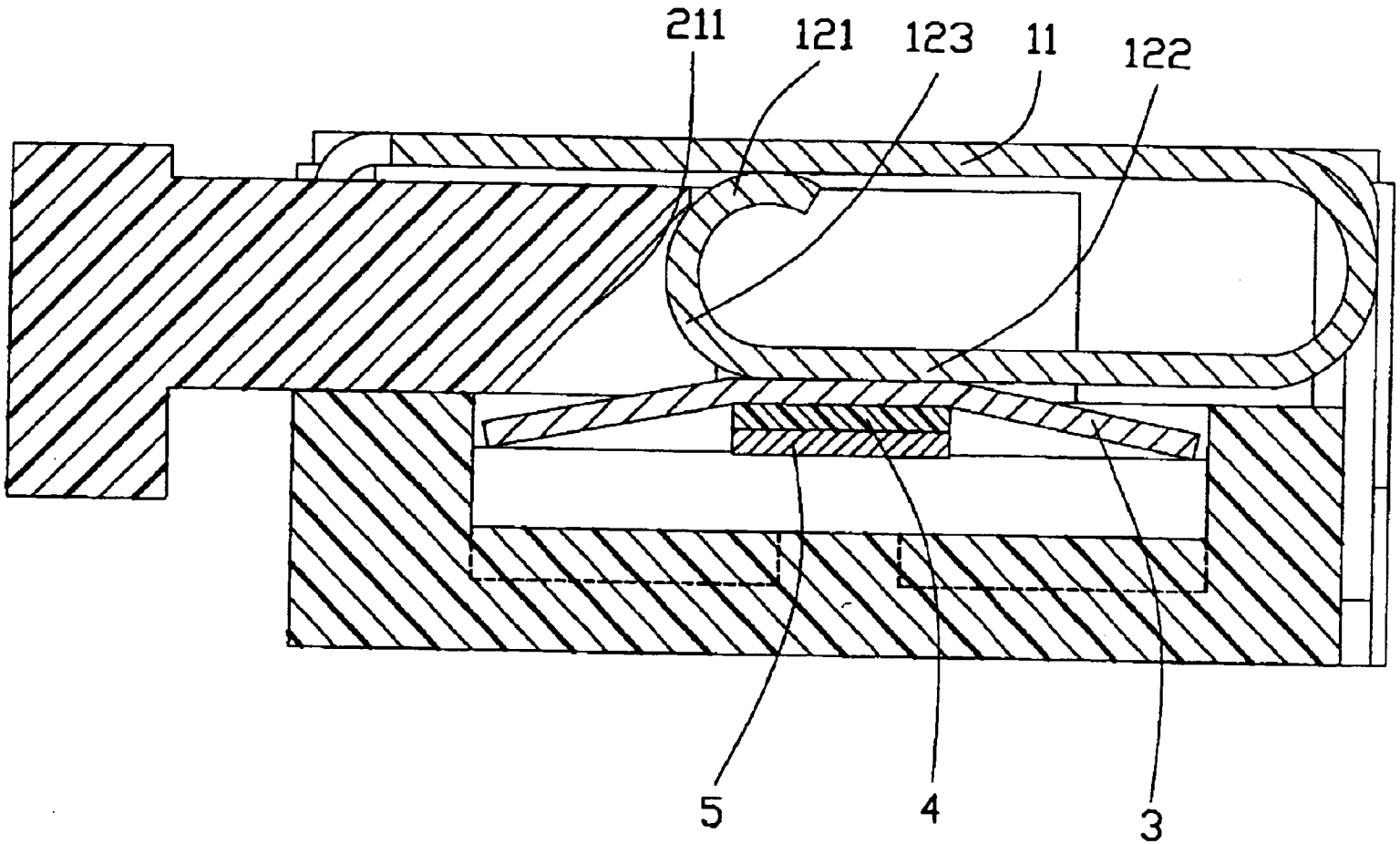
FIG. 3 is a cross-sectional view taken along line 3—3 of FIG. 2.
Figure 4:
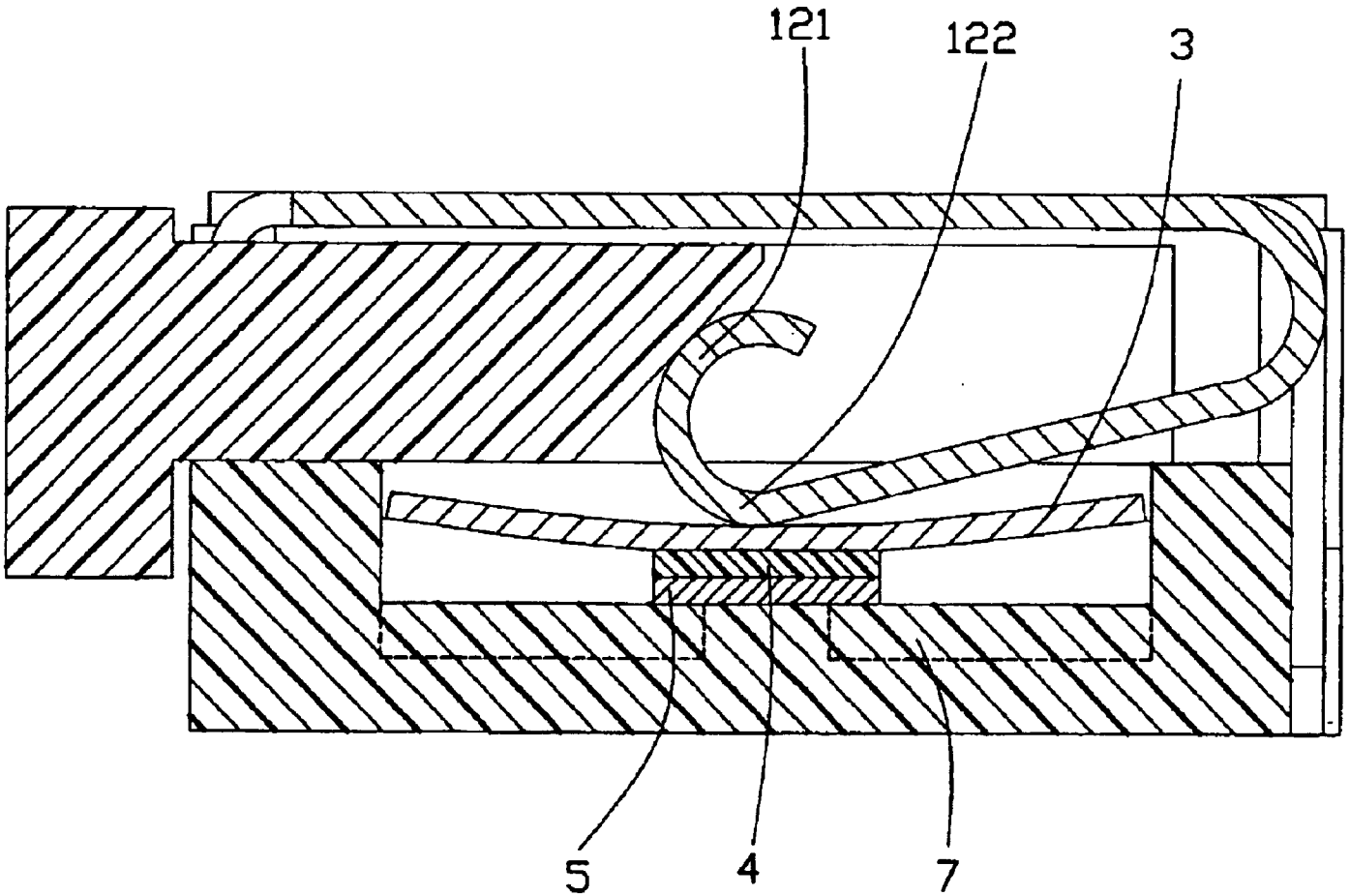
FIG. 4 is a schematic, cross-sectional view showing the metal dome of FIG. 3 being depressed.

Referring also to FIG. 3, the top cover 1 defines a rectangular plate 11. The rectangular plate 11 has a front edge (not labeled), a rear edge (not labeled) and a pair of side edges (not labeled). A lever 12 extends downwardly and inwardly from the rear edge of the plate 11, forming a curved shape under the plate 11. The lever 12 includes a depressing portion 122 at a lower end thereof, a curved end 123 at a forward end thereof, and a contacting portion 121 proximate to the plate 11. Four tangs 13 extend downwardly from the front edge and the rear edge and two tabs 14 extend downwardly from the two side edges. The tangs 13 extending from the front edge of the rectangular plate 11 are spaced from each other a predetermined distance. Each tang 13 has a lateral extended portion 131 projecting sideways from one end thereof.

The actuator 2 has an operating portion 20 at a front thereof and a plate-like body 21 extending rearwardly from the operating portion 20. The plate-like body 21 forms a neck portion 24 at a front end thereof, which connects to the operating portion 20, and a pair of fingers 22 at a rear end thereof, which project rearwardly. A slot 23 is defined between the two fingers 22. A ramp 211 is formed on an underside (not labeled) of the plate-like body 21, just forward of the two fingers 22. A pair of holding portions 25 project to each of two opposite sides of the plate-like body 21.

The metal dome 3 has a central area 31, which has a circular shape and which substantially forms a top-most surface of the metal dome 3. The central area 31 has a top surface (not labeled) and a bottom surface (not labeled). The rubber disc 4 and the conductive disc 5 both have the same size and circular shape as the central area 31 of the metal dome 3.

The four contacts 7 are partially embedded in the housing 6 by insert molding. The housing 6 has a bottom wall 61 and a peripheral wall 62 extending upwardly from the side edges (not labeled) of the bottom wall 61. A cavity (not labeled) is defined within the housing 6 above the bottom wall 61 and within the peripheral wall 62. Two lower steps 63 are formed on opposite sides of the bottom wall 61. The peripheral wall 62 has an upper surface 621, which is higher than the lower steps 63. Two U-shaped upper walls 64 extend upwardly from opposite ends of the peripheral wall 62. A pair of higher steps 65 is formed by the upper surface 621 of the peripheral wall 62 on the two opposite ends of the peripheral wall 62, to an inside of the upper walls 64. A front entrance (not labeled) and a rear entrance (not labeled) is defined between ends of the U-shaped upper walls 64 and along the peripheral wall 62. Four shallow portions 620 are defined in front and rear sides of the peripheral wall 62 for engagement with the lateral extended portions 131 of the tangs 13 of the top cover 1. Two recesses 640 are defined in outward sides of the U-shaped upper walls 64 for engagement with the tabs 14 of the top cover 1.

In assembly, the rubber disc 4 is fixedly attached to the bottom surface of the central area 31 of the metal dome 3. The conductive disc 5 is fixedly attached to a bottom surface of the rubber disc 4. The metal dome 3 with the rubber disc 4 and the conductive disc 5 attached thereto is positioned in the cavity of the housing with each of two opposite ends thereof resting on the lower steps 63 of the housing 6. The actuator 2 is assembled in the housing 6 with the operating portion 20 extending outwardly through the front entrance of the housing 6 and the holding portions 25 being disposed on the higher steps 65 of the housing 6. The top cover 1 is assembled onto the housing 6 by engaging the lateral extended portions 131 of the tangs 13 within the shallow portions 620 of the peripheral wall 62, and engaging the tabs 14 of the top cover 1 with the recesses 640 of upper walls 64. At the same time, the lever 12 of the top cover 1 is received in the slot 23 of the actuator 2, with the upper contacting portion 121 of the lever 12 abutting against the ramp 211 of the actuator 2, and with the lower depressing portion 122 of the lever 12 abutting against the top surface of the central area 31 of the metal dome 3.

In use, the operating portion 20 of the actuator 2 is pressed rearwardly into the housing 6 by a user. The ramp 211 of the actuator 2 moves rearwardly, driving the lever 12 of the top cover 1 downwardly, thereby forcing the lower depressing portion 122 of the lever 12 to depress the metal dome 3, which in turn depresses the conductive disc 5 into electrical contact with all four of the contacts 7, simultaneously electrically connecting the four contacts 7. When the user releases the operating portion 20, a reverse operation occurs wherein the lever 12 presses against the ramp 211, pushing the actuator 2 outwardly, which releases the metal dome 3, allowing the central area 31 to recover upwardly, disconnecting the conductive disc 5 from the four contacts 7, and thus disconnecting the four contacts 7 from each other. Since the conductive disc 5 electrically connects all four contacts 7 within a very small distance, transmission distance is lessened. Also, the compressible rubber disc 4 cushions the actuation of the tact switch 100, which can increase service life of the components.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A tact switch comprising:

an insulative housing;

a plurality of contacts retained in the housing;

an actuating means mounted on the insulative housing;

a metal dome being positioned between the actuating means and the housing, the metal dome having a peripheral portion and a center portion;

a vertically compressible rubber disc fixedly attached to a bottom surface of the center portion of the metal dome for cushioning impact upon the metal dome when contacts impose reaction forces upon the metal dome; and a conductive disc fixedly attached to a bottom surface of the rubber disc and not contacted with the contacts when the metal dome is not deflected downwardly, whereby, when the actuating means is pressed inwardly into the housing, the metal dome is moved such that the conductive disc moves into electrical contact with the contacts.

2. The switch as described in claim 1, wherein a deflectable portion of the metal dome is vertically spaced from the contacts with a distance when said metal dome is not deflected by the actuating means, and a stacked height formed by said conductive disc and said rubber disc is smaller than said distance.

* * * * *